US007296978B2

(12) United States Patent
Kisak et al.

(10) Patent No.: US 7,296,978 B2
(45) Date of Patent: Nov. 20, 2007

(54) COMPRESSED AIR SYSTEM UTILIZING A MOTOR SLIP PARAMETER

(75) Inventors: Jeffrey James Kisak, Erie, PA (US); Mark Alan Linebach, Erie, PA (US); Jason Arthur Dean, Erie, PA (US); Richard Gerald Bliley, Erie, PA (US); Stephen Matthew Pelkowski, Erie, PA (US)

(73) Assignee: General Electric Company, Schenectady, NY (US)

( * ) Notice: Subject to any disclaimer, the term of this patent is extended or adjusted under 35 U.S.C. 154(b) by 573 days.

(21) Appl. No.: 10/767,026

(22) Filed: Jan. 29, 2004

(65) Prior Publication Data

US 2004/0175272 A1 Sep. 9, 2004

Related U.S. Application Data

(60) Provisional application No. 60/452,625, filed on Mar. 6, 2003.

(51) Int. Cl.
*F04B 49/00* (2006.01)
*F04B 49/06* (2006.01)

(52) U.S. Cl. ..... 417/42; 417/18; 417/44.2

(58) Field of Classification Search ..... 417/42, 417/18, 44.2, 53, 34, 22; 318/434, 432; 388/930
See application file for complete search history.

(56) References Cited

U.S. PATENT DOCUMENTS

| | | | | |
|---|---|---|---|---|
| 4,661,751 | A | 4/1987 | Werner | |
| 5,214,367 | A | 5/1993 | Uesugi | |
| 6,026,587 | A * | 2/2000 | Cunkelman et al. | 417/53 |
| 6,238,188 | B1 * | 5/2001 | Lifson | 417/42 |
| 6,390,779 | B1 * | 5/2002 | Cunkelman | 417/14 |
| 2003/0042861 | A1 | 3/2003 | Schwartz et al. | |

* cited by examiner

*Primary Examiner*—Anthony D. Stashick
*Assistant Examiner*—Patrick Hamo
(74) *Attorney, Agent, or Firm*—Carlos Hanze, Esq.; Enrique J. Mora, Esq.; Beusse Wolter Sanks Mora & Maire, P.A.

(57) ABSTRACT

A compressed air system and method of operating the system wherein the slip between the compressor motor and its powering alternator is used as an indication of whether the compressor is running in a loaded or unloaded mode. A slip parameter such as % Slip is determined and compared to an allowable value in real time. If the compressor is determined to be erroneously in a loaded mode, a corrective action may be taken to reduce the probability that the motor is later started with the compressor still in the loaded mode.

17 Claims, 2 Drawing Sheets

COMPRESSED AIR SYSTEM UTILIZING A MOTOR SLIP PARAMETER

This application claims priority to a provisional application filed on Mar. 6, 2003, having application No. 60/452,625, which is incorporated herein by reference.

FIELD OF THE INVENTION

This invention relates generally to the field of locomotives, and more particularly to the compressed air system of a locomotive, and particularly to an improved method and implementing apparatus for diagnosing a malfunction that retains an air compressor in a loaded mode when an unloaded mode is desired.

BACKGROUND OF THE INVENTION

Compressed air systems are used to provide energy for driving a variety of devices in a variety of applications. One such application is a railroad locomotive where compressed air is used to power locomotive air brakes and pneumatic control systems.

A typical compressed air system will include a motor-driven compressor to maintain the air pressure in a reservoir within a desired range of pressures. The compressor is cycled on and off in response to a measurement of pressure in the reservoir. A bypass valve is connected to the outlet of the compressor to selectively vent the compressor to atmosphere for running the compressor in an unloaded mode. The unloaded mode is used when the compressor motor is first energized in order to reduce the starting current drawn by the motor. After the compressor/motor have come up to speed, the bypass valve is closed to place the compressor in the loaded mode for supplying compressed air to the reservoir. After a desired pressure is achieved in the reservoir, the compressor is allowed to run in the unloaded mode for a short period, such as 30 seconds, in order to cool down the compressor and motor components. At the end of the cool down period, the motor is de-energized and the system stands ready to be re-started when the reservoir pressure drops below the low-pressure set point.

On occasion, the compressor/motor will fail to achieve a desired speed within a predetermined time period after the motor is energized. This may be due to a variety of problems, including mechanical failures in the motor or compressor, electrical failures in the motor, power supply or connections, or an improperly positioned bypass valve that leaves the compressor in the loaded mode during start-up. Regardless of the cause of the problem, the failure of the compressor to achieve a desired speed within a predetermined time period will result in the motor being tripped in order to prevent excessive heat buildup in the motor, and a system fault will be logged. With repeated failures to start, the compressed air system will be declared out of service in an effort to protect the induction motor from thermal breakdown, thereby adversely impacting the availability of the locomotive for use.

BRIEF DESCRIPTION OF THE DRAWINGS

These and other advantages of the invention will be more apparent from the following description in view of the drawings that show.

DETAILED DESCRIPTION OF THE INVENTION

Figure 1:
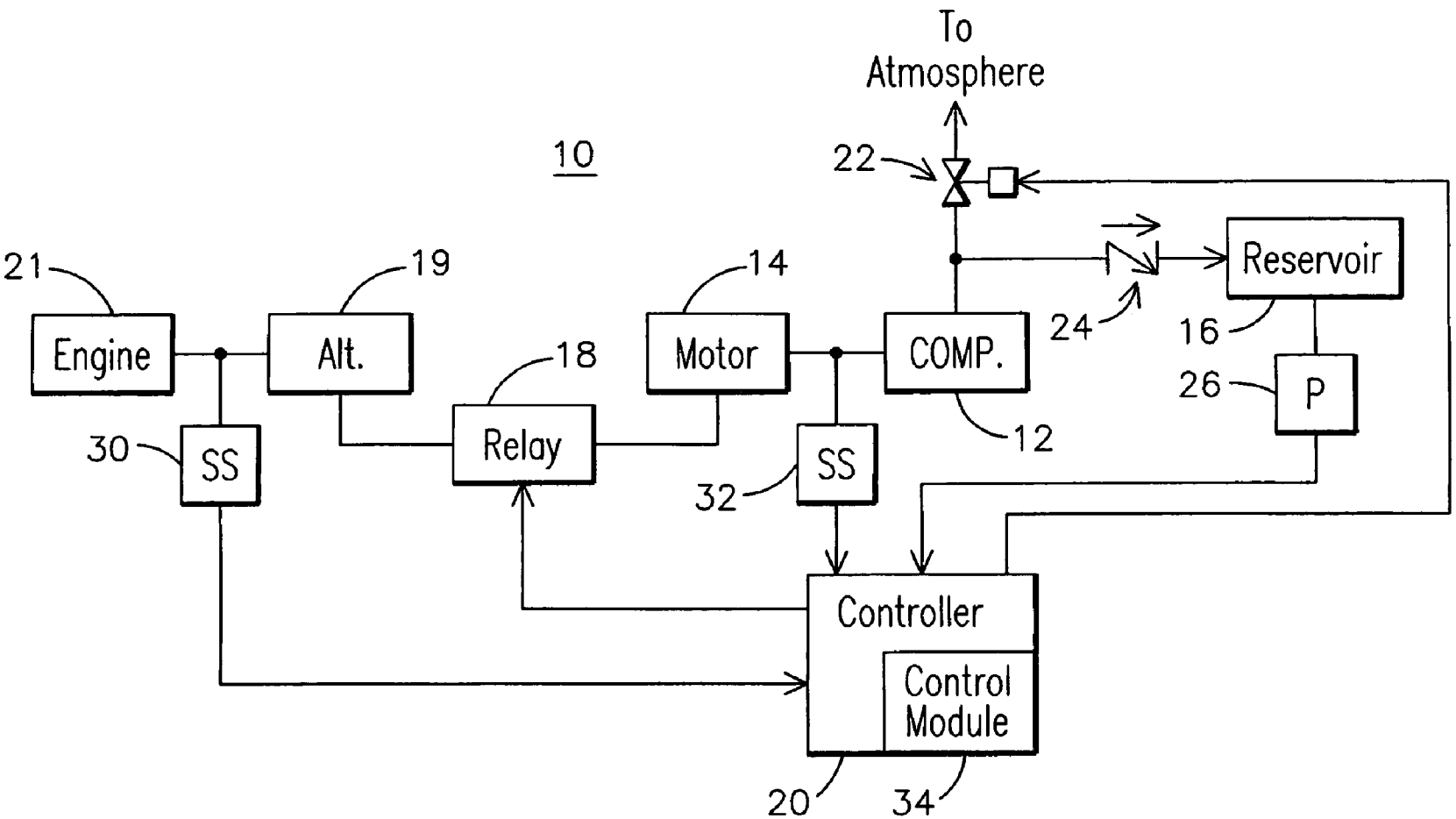
FIG. 1 is a schematic diagram of an improved air compressor system.

Prior art locomotive systems do not provide the operator with any direct indication of appropriate unloading of the compressor, such as may occur during the cool down period after a high-pressure set point has been achieved in the compressed air reservoir. Continued operation of the compressor in the loaded mode may cause a pressure increase in the reservoir until a limit of a safety relief valve is reached. The relief valve will lift for protection of the system but this will not be communicated to the operator. Nor may the abnormally high pressure be alarmed to the operator. The first indication of an improperly loaded compressor may be the failure of the compressor to achieve a desired speed within a predetermined time period after the motor is energized, and even that indication does not unambiguously point to an improperly loaded compressor.

The present inventors have innovatively realized that there is a measurable correlation between the slip of the compressor motor and the state of loading of the compressor. In general, slip is a measure of the difference between the commanded speed of the compressor motor and the actual speed of the motor as it drives the air compressor, For example, for an induction motor when used to drive an air compressor, slip is traditionally defined as $$\% \text{ Slip} = \frac{\omega_s - \omega_m}{\omega_s} * 100$$

where $\omega_m$=angular speed of the rotor shaft, and $\omega_s$=synchronous speed, which is defined by $$\omega_s = \frac{2\omega}{p}$$

where p is the number of poles of the motor and ω is the supply frequency (e.g., rad/s) that powers the motor.

By way of example, the compressor motor in many locomotives can be operated with either 6-poles or 12-poles being active, with the design operating speed for 12-pole operation being twice that of 6-pole operation in order to provide the necessary compressor speed when the locomotive engine is idling or operating at low speeds. This is most helpful for more quickly increasing the air system pressure when the train first pumps up without necessitating an increase in the locomotive engine speed and the resulting increase in fuel usage. Slip may thus determined after taking into consideration the design operating speed of the motor with whichever number of poles has been selected.

It will be appreciated that the supply frequency ω of the alternator 19 that supplies power to the compressor motor is a direct function of the speed (RPM) of the engine 21 of the locomotive. Thus, one may correlate engine speed relative to the actual speed of the motor to obtain an indication of slip. Accordingly, the present inventors have collected a large amount of data correlating the actual speed of the compressor motor and the actual speed of the locomotive engine under a wide range of locomotive operating conditions, with the compressor in both the loaded and the unloaded modes.

The speeds of the engine and compressor can be measured with standard speed sensors, such as electromagnetic speed sensors. In one exemplary embodiment, a percentage of slip may be calculated as follows:

$$\% \text{ Slip}=100*[ES-((\#\text{ of active poles}/\text{Total }\#\text{ of poles})*CS)]/ES$$

where ES is engine speed and CS is compressor speed. The data reveals a significant difference in the percentage of slip between the compressor loaded and the compressor unloaded modes. Depending upon locomotive type and operating condition, the amount of slip during the unloaded mode may be one-half to one-quarter of the slip during the loaded mode. Thus, slip or % slip has been found to be a reliable indicator of the operating mode of the compressor. It will be understood that while slip is described above in terms of relative rotating speeds of an engine and a motor, one skilled in the art will appreciate that a slip parameter may be determined in other ways, such as by comparing the shaft speed of the rotor and the supply frequency. Thus, the present invention should not be construed as being limited to a particular technique for determining the slip parameter. Furthermore, the concept of motor slip as used herein is not limited to an induction motor and, therefore, the present invention should not be limited to induction motors since other types of electromotive machines may be used such as synchronous machines, permanent magnet machines, electronically commutated motors, etc.

An improved compressed air system 10 as may be used on a locomotive or other application is illustrated in FIG. 1. The system includes a compressor 12 that is driven by an electrical motor 14 to provide a flow of compressed air to a reservoir or storage tank 16. A power supply, e.g., an alternator 19, may be coupled through a relay 18 or other such electrical switching device to energize the motor 14. The relay 18 is selectively positioned to energize or to de-energize the motor 14 in response to a motor control signal generated by a controller 20. A locomotive engine 21 may be connected to supply mechanical power to the alternator 19. The flow of compressed air is directed to the reservoir 16 when a bypass valve 22 in the compressed air supply line is closed, i.e. in a compressor loaded position or mode. The flow of compressed air is vented to atmosphere when the bypass valve 22 is open, i.e. in a compressor unloaded position or mode. A check valve 24 prevents compressed air in the tank 16 from escaping through the compressed air supply line. The controller 20 provides a control signal to the bypass valve 22 to command the desired bypass valve position.

The compressed air system of FIG. 1 further includes a pressure transducer 26 for providing a pressure signal responsive to the air pressure in the reservoir 16. Respective rotational speed signals, as may be measured by speed sensors 30 and 32 respectively coupled to the engine/alternator and to the compressor motor, may be used to determine a parameter related to slip of the air compressor motor. This parameter may be predictive of a faulty condition in the compressor, as will be discussed more fully below.

Figure 2:
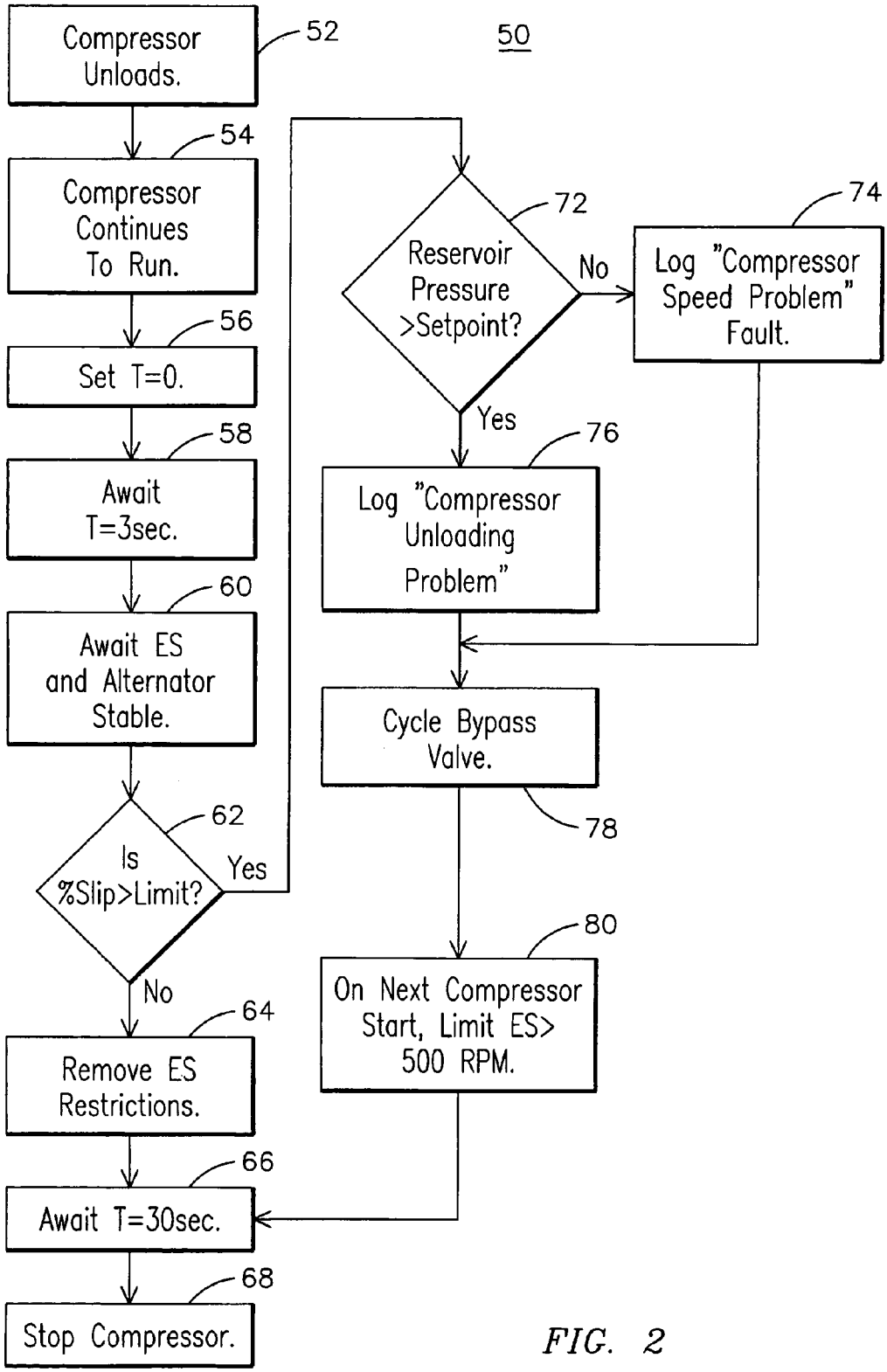
FIG. 2 is a flow diagram illustrating the steps in a method of operating the air compressor system of FIG. 1.

The present inventors envision a locomotive air compressor system, as exemplarily represented in FIG. 1, and a method 50 of operating that system in FIG. 2 that make use of the correlation between % slip and compressor mode in order to provide on-line diagnostics to trigger a preventive action that may reduce the number of failures arising from starting the compressor motor with the compressor loaded. The steps of the method may be stored on software or firmware and may be executed in a control module 34 (FIG. 1) in the controller 20. After the compressor is unloaded at step 52 and is running in the cool down period at step 54, and upon waiting a suitable period of time (e.g., 3 sec.), as indicated at steps 56 and 58, so that the engine speed and alternator are relatively stable at step 60. At this point, the actual slip value may be measured in real time. For example, using speed sensors 30 and 32 (FIG. 1) associated with the engine/alternator and the motor/compressor, an actual percentage slip value is calculated. That actual percentage slip value is then compared at decision point 62 to an upper limit for unloaded operation. The upper limit may be selected from a look-up table on the basis of various operating parameters then existing in the locomotive, for example engine speed, pole position, pressure setting. If the slip is within the allowable limit, the compressor is unloaded and the motor is de-energized at the end of the normal cool down period (e.g., 30 sec), as indicated at steps 66 and 68. (As will be explained in greater detail below, step 64 addresses removal of engine speed restrictions that may be optionally applied, if in a preceding compressor run there was an indication of a fault related to compressor motor slip). If the slip exceeds the allowable upper limit, an appropriate fault log entry is made depending upon whether or not at a decision step 72, the pressure in the reservoir exceeds the normal upper specification limit. If the reservoir pressure is below the upper specification limit, the fault is logged at step 74 as a "Compressor Speed Problem", which may have any of many causes. However, if the reservoir pressure is relatively high, then the cause of the excessive amount of slip is likely due to the compressor being still loaded, and the fault is logged at step 76 as a "Compressor Unloading Problem".

The real-time identification of a compressor-unloading problem allows a corrective action to be taken before the motor is de-energized and the compressor must be re-started. It is not uncommon for the bypass valve to stick due to material build-up within the valve, and it is also not uncommon for the valve to begin operating properly again once it is cycled open and closed once of more times. Accordingly, upon the receipt of a fault related to compressor motor slip, the bypass valve may be cycled at step 78 prior to the compressor being stopped.

In addition, it is known that the motor is more likely to be unable to achieve a desired speed in a desired time if the locomotive engine/alternator are running at a very low idle speed, e.g., 330 RPM. Accordingly, upon the receipt of a fault related to compressor motor slip, as indicated at step 80, the engine speed may be maintained at an elevated value, such as greater than 500 RPM, upon the next start of the compressor. The steps illustrated in FIG. 2 may be repeated for the next run of the compressor, and if the % Slip value then falls below the prescribed limit, the restriction on engine speed may be optionally removed at step 64 for future compressor starts. In some embodiments it may be desirable to maintain the engine speed restriction for at least 5 or 10 additional measurements of compressor slip. Other real-time corrective actions may be envisioned to ensure that the compressor is taken to the unloaded mode. Additional measurements of slip may also be used after the corrective actions are taken to confirm their effectiveness.

One skilled in the art will realize that while a measurement of % Slip is described herein, other parameters related to compressor slip may be used in other embodiments, such as an absolute value of slip or a change in slip versus time, etc. Importantly, the present inventors envision a system and method of operating a motor driven compressor wherein a measurement of motor slip is utilized to diagnose appropriate operation of the compressor system, and wherein preventive and/or corrective actions may be taken responsive to a measurement of slip in order to lessen the chances of a fault or failure in the system.

Aspects of the present invention can be embodied in the form of computer-implemented processes and apparatus for practicing those processes. Aspects of the present invention can also be embodied in the form of computer program code containing computer-readable instructions embodied in tangible media, such as floppy diskettes, CD-ROMs, hard drives, or any other computer-readable storage medium, wherein, when the computer program code is loaded into and executed by a computer, the computer becomes an apparatus for practicing the invention. Aspects of the present invention can also be embodied in the form of computer program code, for example, whether stored in a storage medium, loaded into and/or executed by a computer, or transmitted over some transmission medium, such as over electrical wiring or cabling, through fiber optics, or via electromagnetic radiation, wherein, when the computer program code is loaded into and executed by a computer, the computer becomes an apparatus for practicing the invention. When implemented on a general-purpose computer, the computer program code segments configure the computer to create specific logic circuits or processing modules. Other embodiments may be a micro-controller, such as a dedicated micro-controller, a Field Programmable Gate Array (FPGA) device, or Application Specific Integrated Circuit (ASIC) device.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

We claim as our invention:

1. A method of operating an air compressor system for a railroad locomotive comprising an air compressor, an electric motor receiving electric power from an alternator mechanically coupled to a locomotive engine and driving the air compressor, with the motor being directed to operate at a commanded speed and operating at an actual speed when driving the air compressor, the method comprising:

determining the commanded speed of the electric motor;

determining the actual speed of the motor in driving the air compressor;

determining a parameter indicative of the slip between commanded and actual speeds, wherein the value of the slip is based at least in part on the following relationship:

a difference between locomotive engine speed and compressor speed adjusted by a ratio of a number of active poles relative to a total number of poles of the motor predicting a faulted condition in the operation of the air compressor system in response to the parameter; and generating an indication of the faulted condition regarding the operation of the air compressor system.

2. The method of claim 1, further comprising performing a corrective action responsive to the predicted faulted condition.

3. The method of claim 2, further comprising cycling an air compressor bypass valve in response to the predicted faulted condition.

4. The method of claim 1, further comprising:

comparing the determined parameter to an allowable value; and performing a corrective action when the determined parameter differs from the allowable value by a predetermined value.

5. The method of claim 1, further comprising measuring an air pressure value in a reservoir coupled to receive pressurized air from an air compressor coupled to said air compressor motor, and comparing the measured pressure value relative to a predetermined upper limit for identifying a type of the predicted faulted condition responsive to the slip parameter.

6. The method of claim 5, wherein, when the measured pressure value exceeds the predetermined upper limit, the identified type of predicted faulted condition comprises a compressor unloading faulted condition.

7. The method of claim 5, wherein, when the measured pressure value is below the predetermined upper limit, the identified type of predicted faulted condition comprises a compressor speed faulted condition.

8. The method of claim 6, wherein, when a compressor unloading faulted condition has been identified, on a next start of the compressor motor, commanding an engine speed at a predefined relatively elevated value.

9. A compressed air system for a railroad locomotive comprising:

a compressor;

a motor driving the compressor;

an alternator energizing the motor;

a locomotive engine mechanically coupled to drive the alternator;

a controller comprising logic configured to determine an actual slip between the motor and the alternator, wherein the value of the slip is based at least in part on the following relationship:

a difference between locomotive engine speed and compressor speed adjusted by a ratio of a number of active poles relative to a total number of poles of the motor, wherein ES represents locomotive engine speed and CS represents compressor speed;

a control module for comparing the actual slip to an allowed value of slip.

10. The compressed air system of claim 9 wherein said control module is configured to perform a corrective action responsive to a predicted faulted condition in the operation of the compressed air system.

11. The compressed air system of claim 9 further comprising an air compressor bypass valve, and wherein said control module is configured to cycle said air compressor bypass valve in response to the predicted faulted condition.

12. The compressed air system of claim 9 wherein said control module is configured to compare the determined parameter to an allowable value, and to perform a corrective action when the determined parameter differs from the allowable value by a predetermined value.

13. The compressed air system of claim 9 further comprising a pressure sensor for measuring an air pressure value in a reservoir coupled to receive pressurized air from an air compressor coupled to said air compressor motor, and wherein said control module is configured to compare the measured pressure value relative to a predetermined upper limit for identifying a type of the predicted faulted condition responsive to the slip parameter.

14. The compressed air system of claim 13, wherein, when the measured pressure value exceeds the predetermined upper limit, the identified type of predicted faulted condition comprises a compressor unloading faulted condition.

15. The compressed air system of claim 13, wherein, when the measured pressure value is below the predetermined upper limit, the identified type of predicted faulted condition comprises a compressor speed faulted condition.

16. The compressed air system of claim 13, wherein, when a compressor unloading faulted condition has been identified, the control module is configured to command, on a next start of the compressor motor, an engine speed at a predefined relatively elevated value.

17. The compressed air system of claim 9 comprising part of equipment onboard a locomotive and wherein said power source comprises an alternator coupled to a main engine of the locomotive and wherein said compressed air system further comprises a first speed sensor coupled to one of said alternator and said engine, and a second speed sensor coupled to said air compressor motor, the signals from said first and second speed sensors supplied to said controller to determine the actual slip of said motor.

* * * * *